US007451940B1

(12) United States Patent
Cartwright et al.

(10) Patent No.: US 7,451,940 B1
(45) Date of Patent: Nov. 18, 2008

(54) MOISTURIZER INFUSOR

(76) Inventors: Eloise Cartwright, 3472 Russell Rd., Green Cove Springs, FL (US) 32043; Dan Rankin, 636 Rankin Rd., Danville, KY (US) 40422

( * ) Notice: Subject to any disclaimer, the term of this patent is extended or adjusted under 35 U.S.C. 154(b) by 0 days.

(21) Appl. No.: 11/527,036

(22) Filed: Sep. 26, 2006

(51) Int. Cl.
*B05B 7/30* (2006.01)
*B05B 7/26* (2006.01)
*B05B 7/28* (2006.01)

(52) U.S. Cl. ..... 239/318; 239/310; 4/903

(58) Field of Classification Search ..... 239/318, 239/310, 302, 311, 337, 340, 398, 407, 427, 239/427.3; 137/268, 888, 891, 893, 894; 4/903
See application file for complete search history.

(56) References Cited

U.S. PATENT DOCUMENTS 3,231,200 A * 1/1966 Heald ..... 239/318
3,352,320 A * 11/1967 Camp ..... 137/894
3,764,074 A * 10/1973 James ..... 239/318
3,894,662 A * 7/1975 Eddy et al. ..... 222/630
4,322,036 A 3/1982 Bly
4,623,095 A * 11/1986 Pronk ..... 239/311
4,901,765 A * 2/1990 Poe ..... 137/893
4,998,836 A 3/1991 Scripnick
D326,896 S 6/1992 McNeely
6,419,166 B1 * 7/2002 Brzezinski et al. ..... 239/310
7,028,922 B2 * 4/2006 Leonard et al. ..... 239/318
7,201,331 B2 * 4/2007 Bertrand ..... 239/318

* cited by examiner

*Primary Examiner*—Darren W Gorman
(74) *Attorney, Agent, or Firm*—Lawrence J. Gibney, Jr.

(57) ABSTRACT

This invention will allow an individual to take a shower or bath and apply a moisturizer at the same time by moving a shaft into a particular position on the device. The movement of the shaft section will align a series of internal cavities or internal grooves to produce a vacuum in a connected bottle of moisturizer.

3 Claims, 3 Drawing Sheets

MOISTURIZER INFUSOR

BACKGROUND OF THE INVENTION

A. Field of the Invention

This is related to combining bathing with moisturizing. Specifically, this device will be attached to the shower head and/or to a bath for the purpose of combining a moisturizer with the shower or bath water. A vessel, which contains moisturizer, is attached to the device and moisturizer is drawn through the device through the operation of the venturi principle.

B. Prior Art

There are many other devices in the prior art, which seek to combine a shower head and a moisturizing dispenser. Representative examples of this type of device in the prior art include McNeely, D326,896, Bly, U.S. Pat. No. 4,322,036, and Scripnick, U.S. Pat. No. 4,998,836. The Scripnick and Bly applications employ the use of a Venturi installed in the device.

Similarly, the present application uses a Venturi model in order to drain the moisturizer from an attached vessel and then directly into the shower line. However, the structure and the present application is substantially different from those previously cited in the prior art. The current application also uses a unique method to turn the flow off and on.

BRIEF SUMMARY OF THE INVENTION

This device will allow moisturizing liquid to be placed in the shower line for the purpose of obtaining a hot shower and also moisturizing at the same time. It may also be used while taking a bath. The user of this device can automatically turn this device off and on by sliding a sleeve on the fixture. The device is structured so that when the piece slides from one position to the other a series of holes within the device are aligned in such a way to produce the desired result in this case. In one position a certain amount of water is diverted to create a slight vacuum to draw the moisturizer from an attached vessel. When the slide is placed in a different configuration, the flow of water is not diverted and there is no vacuum created.

The device itself is placed directly in the shower line. It may also be used in the bath but it probably has a more direct application with the shower.

A variety of means to draw the moisturizer from the attached vessel into the shower line, including a slide handle, a push button or toggle switch is also provided.

The device uses the Venturi principle to extract moisturizer from an attached vessel through a tube and into the flow of water into the shower. In order to achieve the venturi effect the flow of water in the shower line must be of adequate pressure and force when passing through a tapered section of the device to produce the desired vacuum to extract the moisturizer from the attached vessel directly into the shower flow.

This effect is accomplished by the flow of water passing from an area of relatively large volume into an area of smaller volume which produces the resultant pressure drop. A shoulder or ridge is placed in the line to insure that the appropriate vacuum is achieved and allows the device to operate. A series of holes or cavities in the interior of part of the device has been provided. This series of cavities or holes must be in a certain position within the interior of the device to insure that the vacuum is created and maintained.

The alignment of the holes is accomplished by sliding a part of a shaft on the device to align the holes in the interior of the device. A push button or a butterfly valve or toggle switch controls the flow of moisturizer from the attached vessel to the device. This positioning of the interior holes creates the desired effect.

Connected to the exterior of the device is a tube that leads to a moisturizing vessel, which contains a predetermined amount of moisturizer. When the shaft of the device—when the interior holes or cavities are in proper alignment—is in a particular position, the vacuum is created and moisturizer is drained from the vessel. When the positions of the shaft sections are placed in other positions relative to each other, the moisturizer is prohibited from entering directly into the shower line because the necessary vacuum is not produced. A check valve in the moisturizing vessel ensures that moisturizer is only drawn from the vessel when the shaft is placed in the appropriate position i.e. when the vacuum is being created.

It is an object of this device to allow an individual to take a hot shower and moisturize at the same time by simply adjusting the position of one device, which has been installed in a shower or bath line.

DETAILED DESCRIPTION OF THE EMBODIMENT

Figure 1:
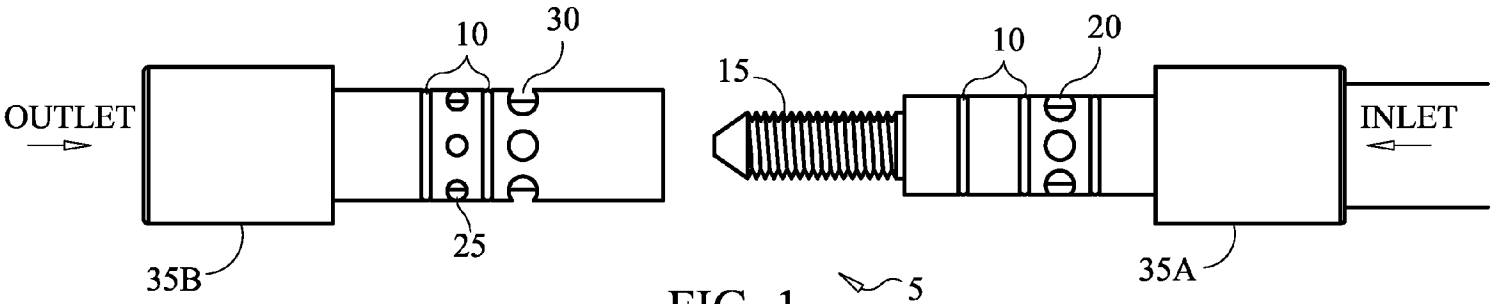
FIG. 1 is an exploded view of two portions of the shaft.
Figure 2:
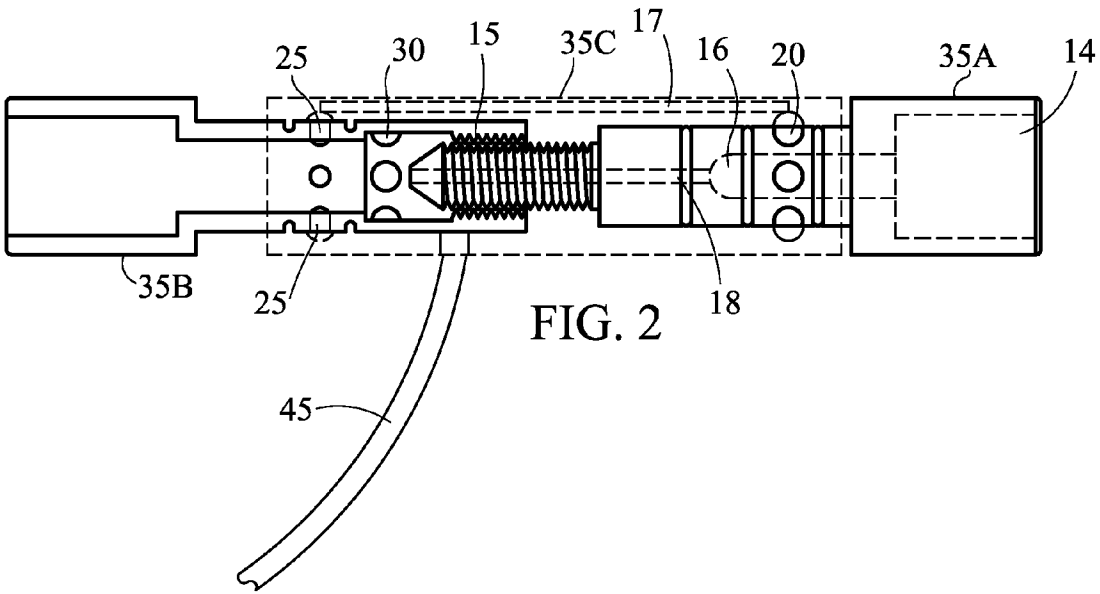
FIG. 2 is a side view of the two fronts of the shaft with the internal shaft mechanism showing the internal grooves and cavities.
Figure 3:
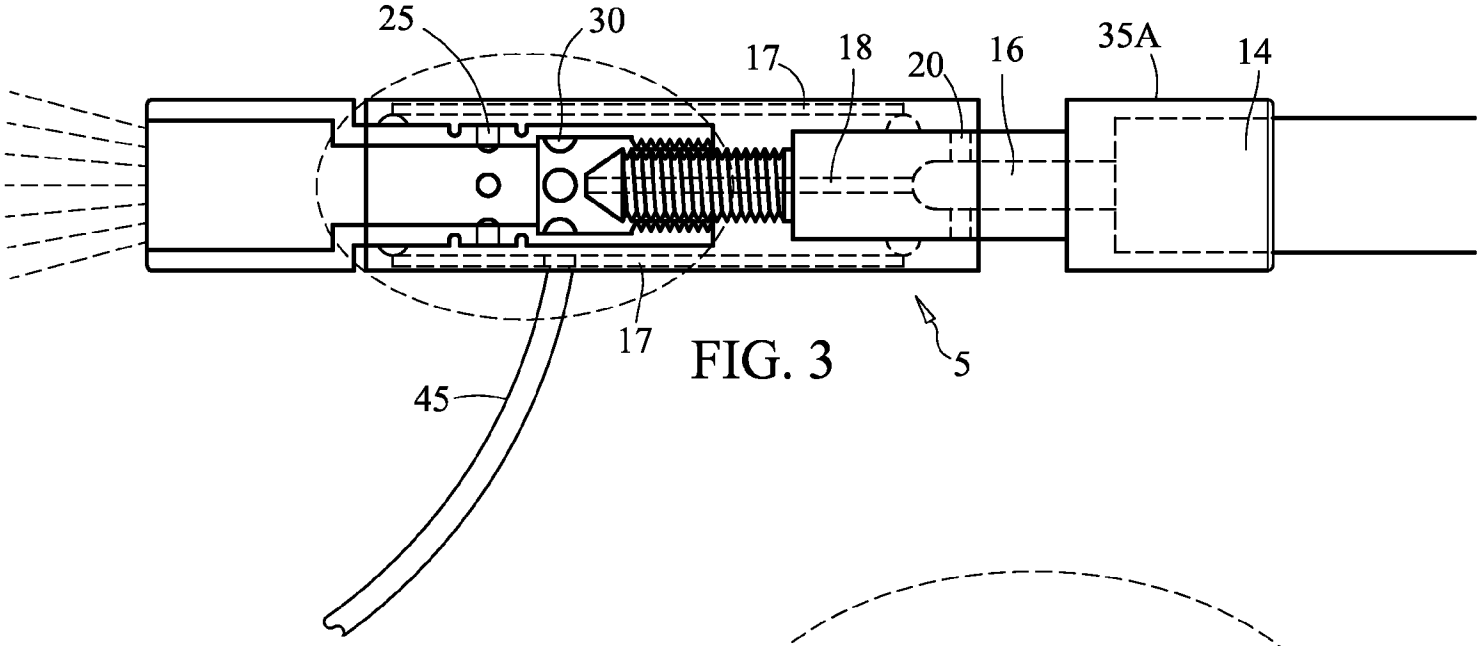
FIG. 3 is a front view of the device showing the internal alignment of the cavities and showing the mechanism through which moisturizer is drained from the moisturizing vessel into the device and the stop gap or shoulder mechanism.
Figure 3A:
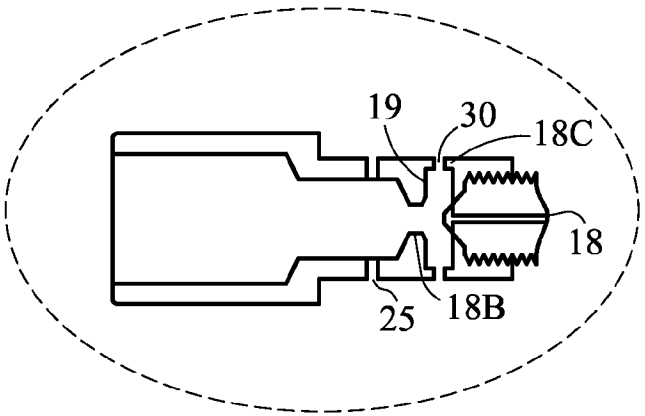
FIG. 3A is an exploded view of a portion of the device depicted in FIG. 3.
Figure 4:
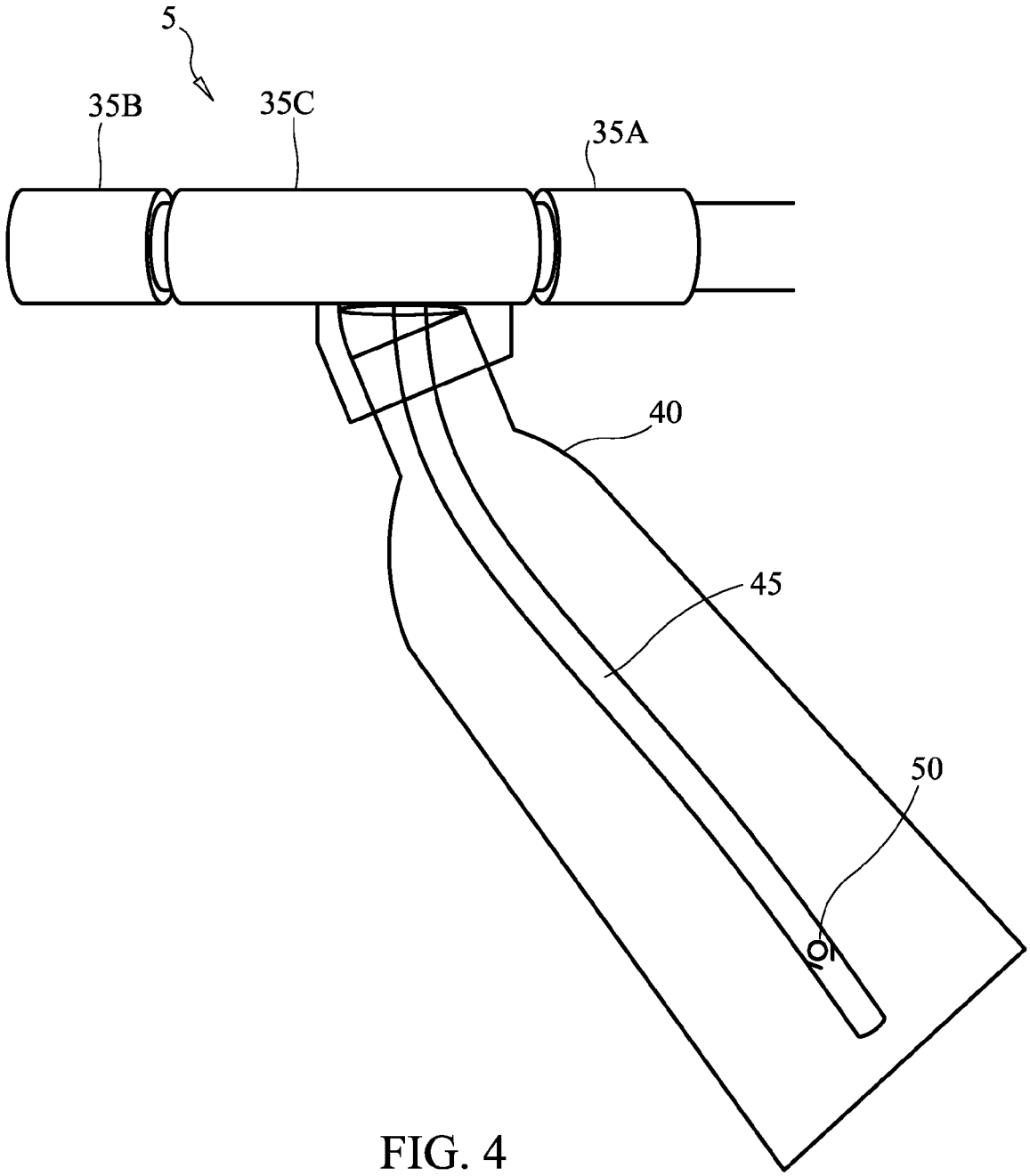
FIG. 4 is a front view of the device showing a moisturizing vessel attached to the device.

This device 5 is comprised of three different sections of shaft 35A, 35B, and 35C. When the device 5 is installed, in the shower or bath line the sections of shaft will align with the water flow from the shower line. This device operates on the venturi principle. The two sections of shaft, 35A and 35B are joined together by a threaded member 15, which mates with a corresponding threaded portion in section 35B.

The water enters through the inlet 14. As the water enters the device it will pass through a series of internally tapered passages: first tapered section 16 and second tapered section 18 where the volume of water that is allowed to pass is restricted because of the internal tapering with section 35A. The water is first restricted by the tapering as depicted in the portion of the shaft labeled 16 and further restricted in another tapered section 18. This tapering restricts the flow of water through the device 5. The flow of water through the tapered sections will result in a reduction of the water flow and an increase in its pressure.

As the water leaves the internal tapered passage 18 the water enters into a much larger cavity relative to the internal passage 18 and through an orifice 18B. This increase in volume creates a vacuum at the point where the water exits the internal passage 18. For that reason it is essential to restrict the flow of water as it enters the device 5 and have the water exit into a much larger area. The moisturizer vessel 40 is connected to the device at the location of this larger opening 30. It is through this space 30 that the moisturizer is drawn into the water flow.

In order to insure that the threaded portion 15 does not close the area in which a vacuum must be created, one end of the threaded portion is slightly elongated to create a lip 18C, which will abut with a piece of stock 19 in the interior of the device on one side of the opening 30. This insures that the individual who is using the device cannot inadvertently close the opening and disrupt the operation of the device.

A series of holes 20 are placed on one end of the first tapered section 16. These holes remain covered by the center shaft 35C to prevent water from exiting through these holes during normal operation of a shower.

When the device is operational for purposes of introducing moisturizing into the shower experience these holes 20 do not align with perimeter passages 17 and prevent the water from bypassing the orifice at the end of passage 18. As the water leaves tapered passage 18 a vacuum is created in the area of the holes or openings 30 due to the water flow going from a restricted area to a much larger area. The moisturizing vessel 40 is positioned to mate with this opening 30 at this point of the device.

When the device is not used to introduce moisturizer, the holes 20 align with perimeter passage 17 and allow water to flow freely through the perimeter passage 17 and exit through holes 25. In this manner water is flowing through the shower head through passage 18 and also through holes 20, perimeter passage 17 and holes 25. In this manner the flow of the shower head is not affected by this device.

At the end of the first section 35A is a threaded piece of stock 15 to mate with a corresponding threaded portion on section 35B.

Along the interior of the sections of shaft section 35C are a series of O-rings 10, which are inserted over a set of grooves to ensure a tight fit as the device is placed within the center section 35C.

This piece of threaded stock 15 on shaft section 35A is mated onto a portion of the outlet portion of the shaft 35B. The tip of the threaded stock 15 is tapered.

It is through this particular passage 18 that the water flows from the inlet to the outlet. It is through this piece of tapered stock 15 that the venturi effect is created. As the water flows at a constant pressure through the shaft into a section of less area a vacuum is created in the line.

A moisturizing vessel 40 is provided with a tube 45, which leads into the moisturizer liquid. A check valve 50 is placed on one end of the tube to ensure that the moisturizer does not spill out of the vessel and only enters the device during the appropriate operating conditions. A method to seal the connection between the moisturizing vessel and the device is also provided to insure that air does not enter the line and thereby destroy the vacuum. This method to seal is probably accomplished by an O-ring, which may be made from neoprene or rubber. Other materials or other means may also be used to provide a seal between the moisturizing vessel and device and no specific means is being claimed.

The moisturizing vessel 40 is attached to the device at the appropriate position relative to the positioning of the internal holes 30 in the device. This method to attach the moisturizing vessel may be accomplished by a threaded mechanism or by a snapping device and no specific means to connect the moisturizing vessel 40 to the device is being claimed. Regardless of the method to attach the moisturizing vessel it is important to maintain a tight seal to prevent the entry of air into the line. The entry of air would destroy the vacuum and would prevent the device from operating in the proper fashion.

The invention claimed is:

1. A device to combine the functions of taking a shower with moisturizing, comprising:

a hollow first shaft section providing an inlet which is attachable to a source of water for the shower;

a hollow second shaft section providing an outlet which is attachable to a shower head;

a hollow third shaft section which fits between the first and third shaft sections; and a vessel containing moisturizing liquid;

the moisturizing vessel being connected in a liquid-tight manner to an exterior portion of the third shaft section, the moisturizing vessel including an internally located liquid tube having a check valve located therein;

the first shaft section having a first end and a second end, wherein the first end of the first shaft section is connected to the source of water for the shower, and wherein a threaded member having a tapered tip forms a portion of the first shaft section and extends longitudinally from the second end of the first shaft section such that the threaded member mates with and is secured to a corresponding internally threaded portion of the second shaft section;

the first shaft section further including first and second internally tapered passages extending from the first end to the second end of the first shaft section, the second internally tapered passage terminating in an orifice defined on the tapered tip of the threaded member, a plurality of holes being circumferentially spaced around a perimeter of a portion of the first shaft section between the first and second ends of the first shaft section, and a plurality of O-rings inserted over a corresponding plurality of grooves externally located on a portion of the first shaft section between the first and second ends of the first shaft section;

the second shaft section having a first end and a second end, wherein the first end of the second shaft section internally receives and is connected with the threaded member of the first shaft section, and wherein the second end of the second shaft section permits attachment of the shower head to the device;

the second shaft section further including a cavity located proximate the first end of the second shaft section immediately downstream of the orifice on the tapered tip of the threaded member, a tapered orifice located centrally within the second shaft section immediately downstream of the cavity, a first plurality of holes located downstream from the cavity and the tapered orifice and being circumferentially spaced around a perimeter of a portion of the second shaft section between the first and second ends of the second shaft section, a second plurality of holes being circumferentially spaced around a perimeter of a portion of the second shaft section between the first and second ends of the second shaft section, the second plurality of holes being located closer than the first plurality of holes to the first end of the second shaft section, the second plurality of holes being fluidly connected to the cavity and the tapered orifice, and a plurality of O-rings inserted over a corresponding plurality of grooves externally located on a portion of the second shaft section between the first and second ends of the second shaft section;

the third shaft section having a first end and a second end, wherein the third shaft section is permitted to slide longitudinally from a first position to a second position over the second end of the first shaft section and the first end of the second shaft section when the threaded member of the first shaft section is secured to the second shaft section;

the third shaft section further including a series of perimeter passages extending longitudinally from a region proximate the first end of the third shaft section to a region proximate the second end of the third shaft section;

whereby when the third shaft section is located in the first position, the plurality of holes formed in the first shaft section are in fluid communication with the perimeter passages of the third shaft section and the perimeter passages of the third shaft section are in fluid communication with the first plurality of holes formed in the second shaft section, such that water flowing through the inlet of the first shaft section flows through the plurality of holes in the first shaft section, through the perimeter passages of the third shaft section, through the first plurality of holes in the second shaft section, and to the outlet of the second shaft section without drawing moisturizer into the water flow; and whereby when the third shaft section is located in the second position, the plurality of holes formed in the first shaft section do not align with the perimeter passages of the third shaft section, and the first and second internally tapered passages of the first shaft section are in fluid communication with the cavity and the tapered orifice of the second shaft section, and the liquid tube of the moisturizing vessel is fluidly connected with the second plurality of holes formed in the second shaft section, such that as water exits the internally tapered passage of the first shaft section, a vacuum is created in the cavity of the second shaft section thereby drawing the moisturizing liquid from the moisturizing vessel through the liquid tube and into the water flow resulting in a combined flow of water and moisturizing liquid passing through the tapered orifice of the second shaft section and exiting the device through the outlet of the second shaft section.

2. The device as described in claim 1, wherein the O-rings are made from neoprene.

3. The device as described in claim 1, wherein the O-rings are made from hard rubber.

* * * * *